US006619241B2

(12) United States Patent
Otterspeer et al.

(10) Patent No.: US 6,619,241 B2
(45) Date of Patent: Sep. 16, 2003

(54) INTERNAL COMBUSTION ENGINE AND METHOD FOR OPERATING AN INTERNAL COMBUSTION ENGINE

(75) Inventors: Rob Otterspeer, Gothenburg (SE); Jan Olof Carlsson, Torslanda (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 09/683,372

(22) Filed: Dec. 19, 2001

(65) Prior Publication Data

US 2002/0083904 A1 Jul. 4, 2002

Related U.S. Application Data

(63) Continuation of application No. PCT/SE99/01947, filed on Oct. 28, 1999.

(30) Foreign Application Priority Data

Jun. 24, 1999 (SE) ..... 9902466-3

(51) Int. Cl.[7] ..... F02B 69/06
(52) U.S. Cl. ..... 123/21; 123/64; 123/198 F
(58) Field of Search ..... 123/21, 198 F, 123/64

(56) References Cited

U.S. PATENT DOCUMENTS 4,392,459 A 7/1983 Chareire
4,641,613 A 2/1987 Delesalle
4,945,870 A * 8/1990 Richeson ..... 123/21
5,036,801 A 8/1991 Imajou
5,113,805 A * 5/1992 Kawamura ..... 123/21
5,131,354 A 7/1992 Richeson
5,154,141 A * 10/1992 McWhorter ..... 123/21
5,193,492 A * 3/1993 Kawamura ..... 123/21
5,517,951 A * 5/1996 Paul et al. ..... 123/21
5,699,758 A * 12/1997 Clarke ..... 123/21
6,286,466 B1 * 9/2001 Braun et al. ..... 123/21
6,363,907 B1 * 4/2002 Arai et al. ..... 123/21

* cited by examiner

*Primary Examiner*—Noah P. Kamen
*Assistant Examiner*—Jason Benton
(74) *Attorney, Agent, or Firm*—Howrey Simon Arnold & White LLP

(57) ABSTRACT

An internal combustion engine and a method for operating the multi-stroke combustion engine is disclosed. The engine is provided with individual variably controlled inlet and outlet valves in each cylinder. Operation of the engine involves controlling the inlet and outlet valves so that the opening and closing of the valves are adapted to a second stroke mode that is different from a first stroke mode in which the engine is presently running. Fuel injected into the cylinders is controlled so that it is injected prior to an expansion stroke. The transition from the first stroke mode to the second stroke mode occurs independent of the operating condition of the engine throughout the entire operating range of the engine.

42 Claims, 4 Drawing Sheets

| No. Cylinder | ignition interval | 2-stroke firing order | 4-stroke firing order | 6-stroke firing ord | 8-stroke firing order |
|---|---|---|---|---|---|
| 1 | $720^0$ | 1 | 1 | 1 | 1 |
| 2 | $360^0$ | 1,2 | 1,2 | ** | ** |
| 3 | $240^0$ | 1,3,2 | 1,3,2 | | 1,2,3 |
| 4 | $180^0$ | 1,3,4,2 | 1,3,4,2 | | ** |
| 5 | $144^0$ | 1,2,4,5,3 | 1,2,4,5,3 | 1,3,5,4,2 | 1,4,3,2,5 |
| 6 | $120^0$ | 1,5,3,6,2,4 | 1,5,3,6,2,4 | | 1,3,2,6,4,5** |
| V6 | $120^0$ | 1,4,3,6,2,5 | 1,4,3,6,2,5 | | 1,3,2*** |
| V8 | $90^0$ | 1,5,2,6,4,8,3,7 | 1,5,2,6,4,8,3,7 | | 1,2,4,3*** |
| V10 | $72^0$ | 1,6,2,7,4,9,5,10,3,9 | 1,6,2,7,4,9,5,10,3,9 | | 1,2,5,4,3*** |
| V12 | $60^0$ | 1,7,5,11,3,9,6,12,2,8,4,10 | 1,7,5,11,3,9,6,12,2,8,4,10 | | 1,5,3,6,2,4*** |
| B10 | $144^0$ | 1,2,4,5,3 | 1,2,4,5,3 | 1,3,5,4,2 | 1,4,3,2,5 |

FIG. 2

INTERNAL COMBUSTION ENGINE AND METHOD FOR OPERATING AN INTERNAL COMBUSTION ENGINE

CROSS REFERENCE TO RELATED APPLICATIONS

The present application is a continuation of International Application No. PCT/SE99/01947, filed Oct. 28, 1999, which claims priority to Swedish Application No. 9902466-3, filed Jun. 24, 1999. Both applications are expressly incorporated herein by reference.

BACKGROUND OF INVENTION

1. Technical Field

The present invention relates to an internal combustion engine and a method for operating a multi-stroke combustion engine provided with individually variable controlled inlet and outlet valves in each cylinder.

2. Background Information

Most current standard production car engines use a principle of operation known as four-stroke operation. These four strokes are referred to as the compression, expansion, exhaust and intake strokes. The principles of two-stroke operation and six-stroke operation are also known but restricted in their frequency of usage. An internal combustion engine that can operate under more than one stroke mode is defined as a multi-stroke engine. In U.S. Pat. No. 5,131,354, the two-, four- and six-stroke operation of an internal combustion engine is described. The six-stroke operation is described only in combination with engine start and warm-up.

In internal combustion engines, the decrease in combustion frequency reduces the maximum output, which can be described as the frequency of combustion times the maximum output per combustion. The maximum output per combustion is determined by the geometry of the engine.

A combination of multiple stroke operation modes can remove this restriction. However, previous considerations regarding the demand for high performance have prevented these more efficient engines with strokes greater than four from becoming more common. The complexity of the required system, which allows for a of a number of stroke operation modes, is extremely high. This complexity makes mass production not cost-effective or feasible.

The system complexity is due to the requirements a combustion cycle sets in combination with the degree of freedom required for multi-stroke operation. Implicit with multi-stroke operation is that changes between two or more stroke modes have to be performed. A smooth transition between two such stroke modes places a high demand on the degree of freedom of the system.

For non-transition between stroke modes, the following can be said. Normal combustion requires all valves in a specific cylinder where the combustion takes place to be closed during a certain part of the combustion. To achieve combustion with normal efficiency, the combustion should occur in the vicinity of top dead center (TDC), i.e., close to the crank angle degree where the piston in the specific cylinder reaches the highest position. These two criteria alone are not problematic in achieving. For a standard production engine, the camshaft and crankshaft are constructed so that this is guaranteed for four stroke operation. However, under multi-stroke operation, the interval or frequency of combustion changes. The change in frequency is a restriction posed by drivability criteria. A non-equidistantly fired engine shows a very unstable or undrivable character, especially at lower speeds and/or high loads. The combination of restrictions, ie., TDC and closed valves, for a combustion of equidistantly fired engine that is achieved for four-stroke operation also has to be met for these different intervals.

As with non-transition, a proper transition between stroke modes is also restricted in its possibilities, again considering the requirements of TDC and closed valves. An additional restriction in this case is the requirement of having an ignitable mixture in the cylinder at firing conditions. This implies that a number of cylinders are excluded from participation in this transition, since they either contain burned gas or have to be prepared for firing during the next cycle. This latter restriction prohibits fired operation, because this will have the implication that the next cycle has burned gas in the cylinder. Pressurized filling methods such as turbo charging, compressor charging and other methods, allow for exhaust and intake in only two strokes.

SUMMARY OF INVENTION

The present invention provides an internal combustion engine that overcomes the above-mentioned disadvantages of closed valves, TDC positioning and ignitable mixture, while providing a method for transition between different stroke modes throughout the entire operating range for an internal combustion engine.

The invention also increases the efficiency of the internal combustion engine, thereby reducing the fuel consumption of the engine. The present invention also an internal combustion engine with reduced emissions.

The internal combustion engine of the present invention operates by controlling the inlet and outlet valves so that the opening and closing of the valves are adapted to a second stroke mode that is different from a first stroke mode in which the engine currently running, controlling the injection of fuel into the cylinders so that fuel is injected prior to an expansion stroke, and transitioning from the first stroke mode to the second stroke mode independent of the operating condition of the engine throughout the entire operation of the engine.

Under constant conditions, i.e., constant power demand, an increase in work performed per combustion can be achieved by reducing the combustion frequency. The increased amount of work performed per combustion increases the efficiency, thereby reducing fuel consumption. However, since an internal combustion engine operates under different loads and speeds, it is essential that the transition between different stroke modes be performed independent of the operating condition of the engine throughout the entire operating range of the engine.

The previously described higher amount of performed work at a lower frequency, improves the combustion conditions in such a way that emissions are reduced under active catalyst conditions.

The present invention also provides a smooth and fast transition between the different stroke modes. This is accomplished by an internal combustion engine having individually and variably controlled inlet and outlet valves in each cylinder and a control device for controlling the ignition.

The control device is able to change the ignition order of the cylinders when the operation of the engine is converted from a first stroke mode to a second stroke mode. The changing of the ignition order leads to a smooth and fast transition between the different stroke modes. This implies that an extra degree of freedom in the system has to be present in order to achieve a transition with consideration for drivability.

With the introduction of electrically controlled valve mechanisms, such as hydraulically, pneumatic, electromagnetic and piezo-electrical, a possibility of adaptation for mass production of an engine that can be operated in a variety of stroke modes has arisen. The electronic control unit can meet the closed valve restriction independent of any engine state.

BRIEF DESCRIPTION OF DRAWINGS

The invention will now be described in greater detail by way of example only and with reference to a particular embodiment illustrated in the drawings, in which:

FIG. 2 is a table of feasible combinations between the number of cylinders and ignition order for internal combustion engines having different numbers and configurations of cylinders.

DETAILED DESCRIPTION

Figure 1:
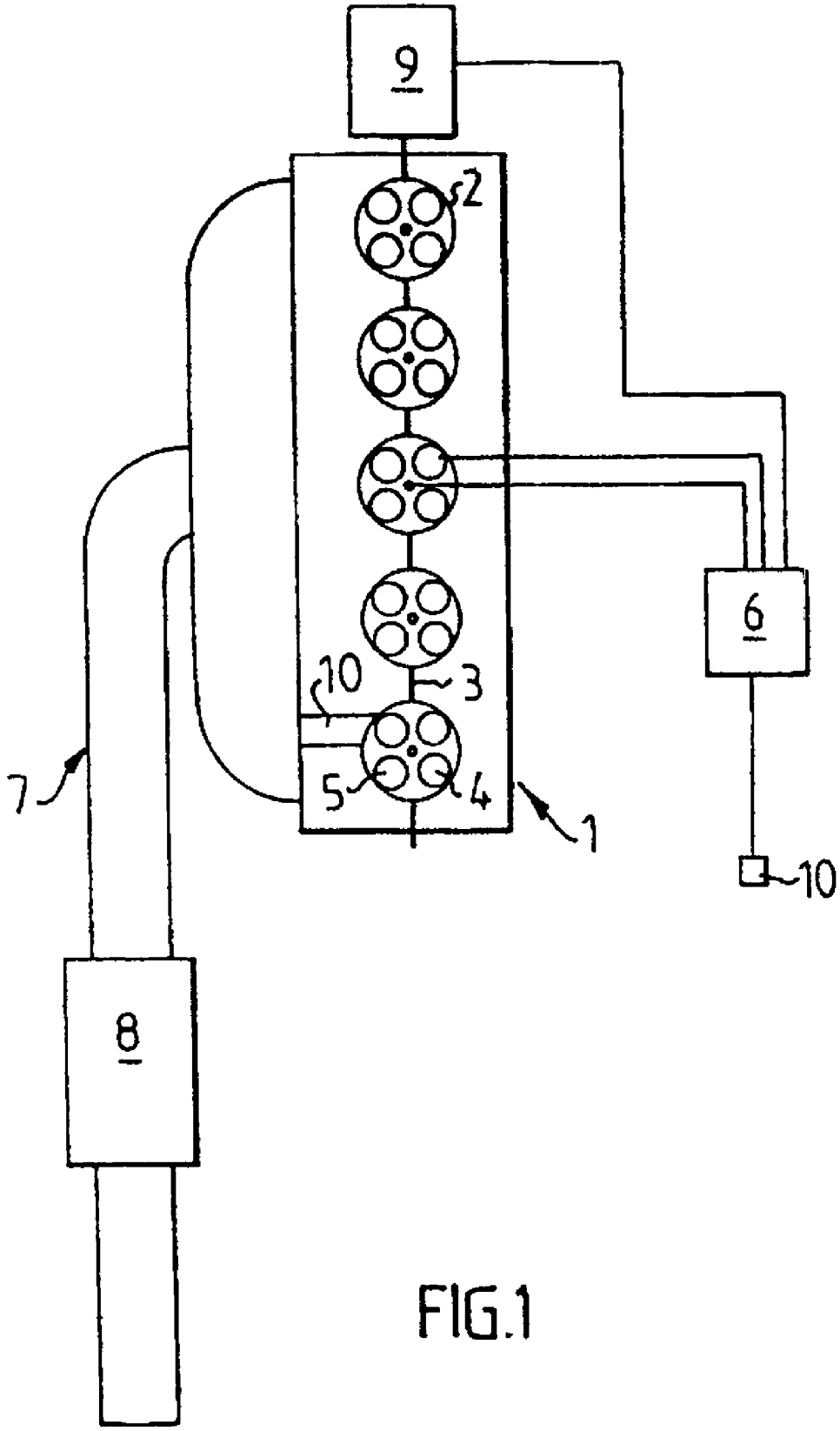
FIG. 1 schematically illustrates a five-cylinder internal combustion engine.

FIG. 1 schematically illustrates an internal combustion engine 1 having five in-line cylinders 2. Each cylinder 2 has a number beginning with the uppermost cylinder 2 in the Figure, which is the number one cylinder and ending with the bottommost cylinder, which is the number 5 cylinder. All cylinders 2 are connected to a crankshaft 3. Preferably, each cylinder 2 is provided with two inlet valves 4 and two outlet valves 5. According to the invention, the valves 4, 5 are individually and variably controlled by a control unit 6. The control unit 6 also controls the ignition timing and the injection of fuel into the cylinders 2. As will be described herein below, the control unit 6 also controls the firing or ignition order of the cylinders 2. For example, a typical firing order for a five-cylinder engine in four-stroke operation is 1, 2, 4, 5, 3 based on the order of the cylinders 2. The internal combustion engine 1 is also provided with an exhaust system 7 having a catalyst 8. It is also possible to arrange an integrated starter generator (ISO) 9 with the engine 1 for transforming power to the engine 1, as will be described herein below. However, it should be recognized that the method and internal combustion engine is not restricted to a five-cylinder engine.

FIG. 2 provides a table explaining how the firing order changes when transitioning from one firing order to another for combustion engines having different numbers of cylinders. The first column provides the number of cylinders. The second column provides the firing interval based upon crank angle for four-stroke operation. The last four columns show the firing order, when geometrically feasible, by giving order of ignition based upon an engine designed with the firing order in the column for four-stroke operation. Different firing orders are possible and merely require reassigning the cylinder numbers, but the principle illustrated in this table on how to change between modes is still valid.

The first six lines in the table of FIG. 2 refers to in-line engines having up to six cylinders. The subsequent lines refer to V-engines having six, eight, ten or twelve cylinders, and to a boxer engine having ten cylinders.

Some cells in the table contain a double asterisk (**) This refers to equidistant ignition achieved with cylinder deactivation. In this mode, at least one of the cylinders is deactivated and does not generate any positive work for the engine. It should be recognized that a special case exists for the six cylinder in-line engine, which allows for both cylinder deactivation and eight-stroke operation.

Cells which contain a triple asterisk (*) are cases where eight-stroke operation can be achieved by deactivation of one of the cylinder banks. In the example illustrated in FIG. 2**, the first bank represented by the low cylinders numbers are active while the second bank is deactivated. However, it is also possible to deactivate the first bank and activate the second bank.

The boxer engine (B10) with ten cylinders is only described with reference to the ignition in one side of the engine. In this example, cylinder number 6 is ignited simultaneously with cylinder number one, cylinder number 7 is ignited simultaneously with cylinder number two, and so forth. W-engines can be constructed so that they also allow for different stroke modes.

Figure 3A:
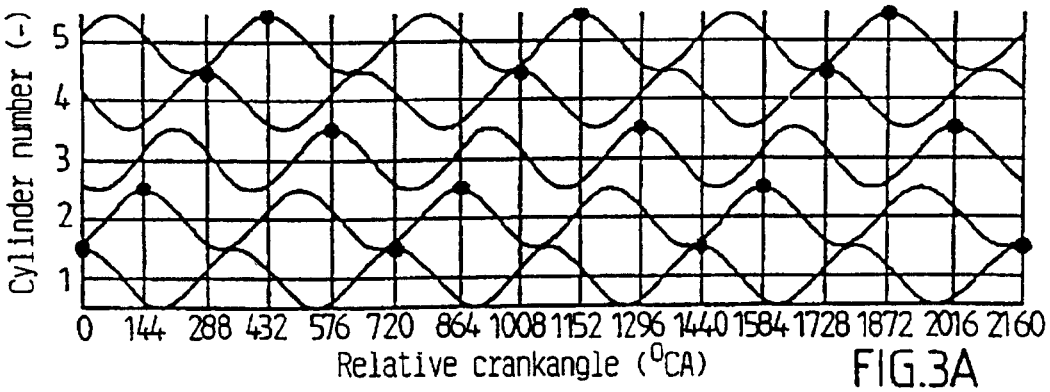
FIG. 3A is a graphical illustration of the piston movement of a five-cylinder engine that operates in four-stroke mode.
Figure 3B:
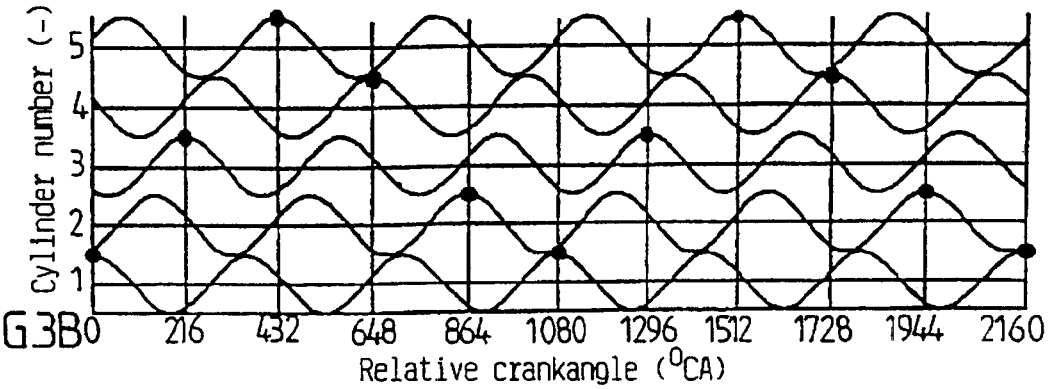
FIG. 3B is a graphical illustration of the piston movement of a five-cylinder engine that operates in six-stroke mode.
Figure 4:
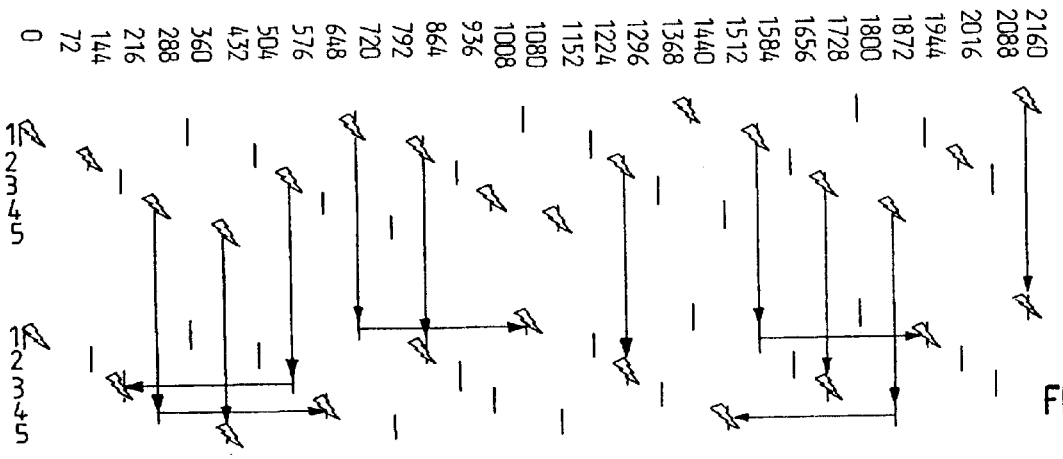
FIG. 4 illustrates the transition from four-stroke to six-stroke operation with ignition events based upon relative crank angle.

FIGS. 3A, 3B and 4 provides as an example the implementation of six- and four-stroke operation and the transition between two modes of a five-cylinder engine having a cylinder firing order 1, 2, 4, 5, 3 for four-stroke operation. Such an engine 1 has been described in connection to FIG. 1.

By definition, one revolution of the crank shaft provides two strokes that are 180° crank angle (CA) in length. For a five-cylinder engine having equidistant ignition or firing order and four-stroke operation, an interval of 144° CA is mathematically correct. The interval is calculated by multiplying the number strokes by the crank angle 180° and dividing the total by the number of cylinders (720° CA/5=144° CA). Under the same conditions for six-stroke operation, the interval becomes (1080° CA/5)=216° CA.

The four-stroke operation, graphically illustrated in FIG. 3A, is not explained herein since this mode of operation is readily known to one skilled in the art. The six-stroke operation, graphically illustrated in FIG. 3B, requires 216° CA between firing of the individual cylinders 2 as noted above. Therefore, starting with the first cylinder at 0° CA, the next ignition must take place at 216° CA. This can be accomplished by igniting the third cylinder, illustrated in FIG. 3B with a dot on the sinusoidal line. It can be determined that ignition takes place at 576° CA (4×144° CA). However, by igniting 360° CA earlier, which is also a top dead center event, the 216° CA criteria is achieved. The next ignition must take place after 432°, which can be achieved by igniting the fifth cylinder. It can be calculated that 432° CA (3×144° CA) is the angle when ignition takes place. The remaining steps consist of the same algorithm, ie., every second firing event, or non-synchronous firing event, the necessary criteria are achieved for a cylinder located 360° forward or backward as illustrated in FIG. 3B, can be moved these 360°, and every other second firing event, a synchronous firing event, i.e., the required criteria are achieved for a cylinder at the exact same crank angle as the firing event, can be used.

The relocation of non-synchronous firing events is achieved by the engine control unit 6 for relocating the ignition, injection and valve events. The concept of synchronous and non-synchronous events is viewed as a six-stroke from a four-stroke point of view. From a six-stroke point of view, all events in six-stroke operation are synchronous, and four-stroke events are both non-synchronous and synchronous.

In case of transition from one mode to another, a discontinuity occurs in the ignition interval. For six- and four-stroke operation transitions, a transition from 144° to 216° CA or vice versa occurs. The requirement for a fresh mixture of air and fuel in the cylinders limits the choice of possible cylinders 2 in such a way that an intermediate mode of only one combustion is applied. The jump for both transitions between four- and six-stroke mode has both this intermediate interval of 288° CA to the previous combustion and the required interval depending on the direction of the jump to the next combustion.

The graph shown in FIG. 4 illustrates a transition from four-stroke to six-stroke operation of a five-cylinder combustion engine 1. The upper or top bar provides the relative crank angle degrees. The lightning symbol indicates an ignition event, while the black vertical bars reflect the TDC events. The numbers on the left side of the graph designate the cylinders 2. The upper half of the graph refers to the four-stroke process, while the lower half of the graph represents the six-stroke process. The arrows indicate how the original four-stroke ignition order has to be changed in order to achieve the six-stroke ignition order.

As illustrated, the four-stroke operation mode ignition order is 1,2,4,5,3 with an ignition interval of 144° CA. To achieve six-stroke operation, the vertical arrows only point out the location where the ignition should occur in those instances where the ignition interval equals the required 216° CA. In certain cases there are horizontal arrows. These horizontal arrows indicate that the obtained TDC is not the requested TDC, since the distance to a previous ignition is not equal to 216° CA. In practice, this means that a subsequent TDC has to be used. This step requires that the valves be closed in addition to the correct conditions for the mixture preparation. This last restriction can be accomplished by using a completely independent valve actuation system. The ignition order of the five-cylinder engine 1 for six-stroke operation mode after transition from four-stroke mode is 1,3,5,4,2 with an ignition interval of 216° CA.

The transition between stroke modes disclosed in FIG. 2, other than four-stroke 20 and six-stroke modes, is achieved in a manner similar to the transition between the four-stroke and six-stroke modes described above. The transition between the stroke modes can take place independent of the operating condition of the engine 1 throughout the entire operation range of the engine 1. Hence, a transition between different stroke modes can be made regardless of the load, temperature and speed of the engine 1.

It may be desirable to manually control the engine 1 so that it runs in only one single stroke mode during certain operating conditions of the engine 1. To achieve this, a switch 10 (FIG. 1) is connected to the control unit 6. When the switch 10 is pressed, the engine 1 is set to run in only one single stroke mode.

The transition between the different stroke modes described above is smooth and fast since the firing order of the engine 1 is changed. However, a number of strategies are possible to make the transition between the different stroke modes even more smoother. Active methods of intervention could include, among others, temporary integrated starter generator (ISG) 9 utilization and output adaptations for smoothing the transition. The ISG 9 works as a combined starter and generator for the internal combustion engine 1. If there is a power reduction from the engine 1 during transition, the ISG 9 can work as an electrical machine, thereby transforming power to the engine 1. In FIG. 1, the ISG 9 is connected directly to the engine crank shaft 3.

The six-cycle mode of operation has extra compression and expansion strokes in relation to a four-stroke mode. The extra strokes can be used for multiple purposes, such as early induction of the mixture, This mode increases the amount of time the mixture is contained within the cylinder 2, subjecting the mixture to a longer and more intense mixture preparation, resulting in improved combustion conditions. Also, the amount of heat transferred from the cylinder walls to the mixture is increased, thereby improving combustion conditions.

The catalyst 8 only reduces emissions in the exhaust gases from the engine 1 when the temperature of the catalyst 8 has reached a predetermined temperature, referred to as the "light-off temperature". Therefore, it is preferred that this predetermined temperature is reached as fast as possible under warm-up conditions of the engine 1. One method of accomplishing this according to the invention is to control the operation of the engine during cold starting so that a relatively high concentration of hydrogen in the exhaust gas is obtained. The air/fuel mixture to the engine 1 is controlled so that the engine 1 is given excess fuel that, according to known principles, generates a certain amount of hydrogen and carbon monoxide in the exhaust gas. If additional air is added to the exhaust gas so that a gas mixture is created comprising exhaust gas and the added secondary air, an increased oxidation of combustible components in the exhaust gas occurs. The oxidation of the combustible components in the exhaust gas leads to an increase of the temperature in the exhaust system 7, and thereby in the catalyst 8. Hence, a rapid catalyst light-off temperature is achieved.

The secondary air is added into an outlet channel 10 of the engine 1 during the extra strokes under six or higher stroke modes. Under the extra strokes, the outlet valves 5 are opened a short period allowing air to be added to the exhaust gas in the outlet channel 10. As a result, oxidation of the combustible components in the exhaust gas is provided, leading to a temperature increase in the exhaust system 7. Once the catalyst light-off temperature has been reached, the air/fuel mixture to the engine 1 is set to normal values and no additional air is added to the exhaust gas under the extra strokes. However, the engine coolant working temperature has not yet been reached at this stage.

When the light-off temperature of the catalyst has been reached, the extra strokes under six or higher stroke modes can be moved so that they occur after the expansion stroke during the engine coolant warming up period. During the extra stokes the exhaust gas is captured in the cylinders so that the high temperature of the exhaust gas warms the cylinder walls and, thereby, the coolant. When the coolant has reached its working temperature, the extra strokes are moved so that they occur before the expansion stroke, thereby improving combustion conditions as mentioned above.

Another method of achieving a rapid catalyst light-off is to open the outlet valves 5 early during the expansion stroke. Hence, a part of the expansion will take place in the exhaust system 7, leading to a substantial increase in the catalyst temperature. When the catalyst 8 has reached the light-off temperature, the outlet valve(s) 5 is set to work under normal conditions.

The above described method can be implemented straightforwardly in order to achieve any combination of internal combustion engine, firing order and stroke modes.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. An internal combustion engine comprising:

individual variably controlled inlet and outlet valves in each cylinder, and a control unit for controlling the ignition, wherein the control unit is adapted to change the ignition order of the cylinders when the operation of the engine is converted from a first stroke mode to a second stroke mode.

2. The engine according to claim 1, wherein the first stroke mode is a four-stroke operation and the second stroke mode is a six-stroke operation.

3. The engine according to claim 2, wherein the engine has five cylinders with the ignition order under four-stroke operation being 1,2,4,5,3 based on the number of the cylinders, and with the ignition order under six-stroke operation being 1,3,5,4,2 based on the number of the cylinders.

4. The engine according to claim 1, wherein the control unit changes the ignition order of the cylinders when the operation of the engine is converted from the first stroke mode to a third stroke mode.

5. The engine according to claim 1, wherein the control unit changes the ignition order of the cylinders when the operation of the engine is converted from the second stroke mode to a fourth stroke mode.

6. The engine according to claim 4, wherein the third stroke mode is a two-stroke operation.

7. The engine according to claim 5, wherein the fourth stroke mode is a eight-stroke operation.

8. The engine according to claim 6, wherein the engine has five cylinders and the ignition order under two-stroke operation is 1,2,4,5,3 based on the number of the cylinders.

9. The engine according to claim 7, wherein the engine has five cylinders and the ignition order under eight-stroke operation is 1,4,3,2,5 based on the number of the cylinders.

10. A method for operating a multi-stroke combustion engine provided with individually variable controlled inlet and outlet valves in each cylinder, the method comprising the steps of:

controlling the inlet and outlet valves so that the opening and closing of the valves are adapted to a second stroke mode different from a first stroke mode in which the engine is currently running, controlling the injection of fuel into the cylinders so that fuel is injected prior to an expansion stroke, transitioning from the first stroke mode to the second stroke mode independent of the operating condition of the engine throughout the entire operating range of the engine, and changing the ignition order of the cylinders so that a substantially equidistant ignition order between the cylinders is achieved for the second stroke mode.

11. The method according to claim 10, further comprising the step of selecting an intermediate ignition when transitioning from the first stroke mode to the second stroke mode, wherein the intermediate ignition occurs in a cylinder prepared for combustion in the first stroke mode, and wherein intermediate ignition is located at a crank angle substantially intermediate between the last ignition in the first stroke mode and the first ignition in the second stroke mode.

12. The method according to claim 10, further comprising the step of transitioning from the first stroke mode to the second stroke mode when the operation of the engine changes from a first predetermined condition to a second predetermined condition.

13. The method according to claim 10, wherein the first stroke mode is a four-stroke operation and the second stroke mode is a six-stroke operation.

14. The method according to claim 10, wherein the engine has five cylinders with the ignition order under four-stroke operation being 1, 2, 4, 5, 3 based on the number of the cylinders, and under six-stroke operation is 1, 3,5, 4, 2 based on the number of the cylinders.

15. The method according to claim 10, further comprising the step of transitioning from the first stroke mode to a third stroke mode.

16. The method according to claim 15, wherein the third stroke mode is a two-stroke operation.

17. The method according to claim 16, wherein the engine has five cylinders and the ignition order under two-stroke operation is 1, 2, 4, 5, 3 with respect to the number of cylinders.

18. The method according to claim 10, further comprising the step of transitioning from the second stroke mode to a fourth stroke mode.

19. The method according to claim 18, wherein the fourth stroke mode is an eight-stroke operation.

20. The method according to claim 19, wherein the engine has five cylinders and the ignition order under eight-stroke operation is 1, 4, 3, 2, 5 with respect to the number of cylinders.

21. The method according to claim 10, further comprising the step of activating an integrated starter generator coupled to the engine when transitioning between the different stroke modes so that substantially stable running conditions of the engine are achieved during the transition.

22. The method according to claim 10, further comprising the steps of:

controlling air/fuel mixture to the engine so that an excess fuel is given to the engine under warming up conditions of a catalyst of the engine, adding additional air to the exhaust gas from the engine so that a gas mixture comprising exhaust gas and the added additional air is achieved in an exhaust system of the engine, and oxidizing combustible components in the exhaust gas, thereby leading to an increase in the temperature of the catalyst.

23. A method for operating a multi-stroke combustion engine provided with individually variable controlled inlet and outlet valves in each cylinder, the method comprising the steps of:

controlling the inlet and outlet valves so that the opening and closing of the valves are adapted to a second stroke mode different from a first stroke mode in which the engine is currently running, controlling the injection of fuel into the cylinders so that fuel is injected prior to an expansion stroke, and transitioning from the first stroke mode to the second stroke mode independent of the operating condition of the engine throughout the entire operating range of the engine, wherein the engine has five cylinders with the ignition order under four-stroke operation being 1, 2, 4, 5, 3 based on the number of cylinders, and under six-stroke operation being 1, 3, 5, 4, 2 based on the number of cylinders.

24. The method according to claim 23, further comprising the step of changing the ignition order of the cylinders so that a substantially equidistant ignition order between the cylinders is achieved for the second stroke mode.

25. The method according to claim 23, further comprising the step of selecting an intermediate ignition when transitioning from the first stroke mode to the second stroke mode, wherein the intermediate ignition occurs in a cylinder prepared for combustion in the first stroke mode, and wherein intermediate ignition is located at a crank angle substantially intermediate between the last ignition in the first stroke mode and the first ignition in the second stroke mode.

26. The method according to claim 23, further comprising the step of transitioning from the first stroke mode to the second stroke mode when the operation of the engine changes from a first predetermined condition to a second predetermined condition.

27. The method according to claim 23, wherein the first stroke mode is a four-stroke operation and the second stroke mode is a six-stroke operation.

28. The method according to claim 23, further comprising the step of transitioning from the first stroke mode to a third stroke mode.

29. The method according to claim 28, wherein the third stroke mode is a two-stroke operation.

30. The method according to claim 29, wherein the engine has five cylinders and the ignition order under two-stroke operation is 1, 2, 4, 5, 3 with respect to the number of cylinders.

31. The method according to claim 23, further comprising the step of transitioning from the second stroke mode to a fourth stroke mode.

32. The method according to claim 31, wherein the fourth stroke mode is an eight-stroke operation.

33. The method according to claim 32, wherein the engine has five cylinders and the ignition order under eight-stroke operation is 1, 4, 3, 2, 5 with respect to the number of cylinders.

34. The method according to claim 23, further comprising the step of activating an integrated starter generator coupled to the engine when transitioning between the different stroke modes so that substantially stable running conditions of the engine are achieved during the transition.

35. The method according to claim 23, further comprising the steps of:

controlling air/fuel mixture to the engine so that an excess fuel is given to the engine under warming up conditions of a catalyst of the engine, adding additional air to the exhaust gas from the engine so that a gas mixture comprising exhaust gas and the added additional air is achieved in an exhaust system of the engine, and oxidizing combustible components in the exhaust gas, thereby leading to an increase in the temperature of the catalyst.

36. A method for operating a multi-stroke combustion engine provided with individually variable controlled inlet and outlet valves in each cylinder, the method comprising the steps of:

controlling the inlet and outlet valves so that the opening and closing of the valves are adapted to a second stroke mode different from a first stroke mode in which the engine is currently running, controlling the injection of fuel into the cylinders so that fuel is injected prior to an expansion stroke, transitioning from the first stroke mode to the second stroke mode independent of the operating condition of the engine throughout the entire operating range of the engine, and transitioning from the first stroke mode to a third stroke mode, wherein the third stroke mode is a two-stroke operation, and wherein the engine has five cylinders and the ignition order under two stroke operation is 1, 2, 4, 5, 3 with respect to the number of cylinders.

37. The method according to claim 36, further comprising the step of changing the ignition order of the cylinders so that a substantially equidistant ignition order between the cylinders is achieved for the second stroke mode.

38. The method according to claim 36, further comprising the step of selecting an intermediate ignition when transitioning from the first stroke mode to the second stroke mode, wherein the intermediate ignition occurs in a cylinder prepared for combustion in the first stroke mode, and wherein intermediate ignition is located at a crank angle substantially intermediate between the last ignition in the first stroke mode and the first ignition in the second stroke mode.

39. The method according to claim 36, further comprising the step of transitioning from the first stroke mode to the second stroke mode when the operation of the engine changes from a first predetermined condition to a second predetermined condition.

40. The method according to claim 36, further comprising the step of activating an integrated starter generator coupled to the engine when transitioning between the different stroke modes so that substantially stable running conditions of the engine are achieved during the transition.

41. The method according to claim 36, further comprising the steps of:

controlling air/fuel mixture to the engine so that an excess fuel is given to the engine under warming up conditions of a catalyst of the engine, adding additional air to the exhaust gas from the engine so that a gas mixture comprising exhaust gas and the added additional air is achieved in an exhaust system of the engine, and oxidizing combustible components in the exhaust gas, thereby leading to an increase in the temperature of the catalyst.

42. A method for operating a multi-stroke combustion engine provided with individually variable controlled inlet and outlet valves in each cylinder, the method comprising the steps of:

controlling the inlet and outlet valves so that the opening and closing of the valves are adapted to a second stroke mode different from a first stroke mode in which the engine is currently running, controlling the injection of fuel into the cylinders so that fuel is injected prior to an expansion stroke, transitioning from the first stroke mode to the second stroke mode independent of the operating condition of the engine throughout the entire operating range of the engine, and activating an integrated starter generator coupled to the engine when transitioning between the different stroke modes wherein substantially stable running conditions of the engine are achieved during the transition.

* * * * *